United States Patent [19]

Yamaguchi

[11] 4,112,725

[45] Sep. 12, 1978

[54] METHOD AND APPARATUS FOR CONTINUOUSLY HOT-STRETCHING A STEEL CABLE

[75] Inventor: Yasuo Yamaguchi, Itami, Japan

[73] Assignee: Sumitomo Electric Industries, Ltd., Osaka, Japan

[21] Appl. No.: 832,863

[22] Filed: Sep. 13, 1977

[30] Foreign Application Priority Data

Sep. 14, 1976 [JP] Japan ..... 51-110587

[51] Int. Cl.[2] ..... B21F 21/00

[52] U.S. Cl. ..... 72/128; 72/342; 72/364; 72/378

[58] Field of Search ..... 72/128, 202, 286, 288, 72/289, 342, 364, 378

[56] References Cited

U.S. PATENT DOCUMENTS

| | | | |
|---|---|---|---|
| 3,871,205 | 3/1975 | Fenton | 72/128 |
| 3,964,938 | 6/1976 | Tolliver et al. | 72/202 |

FOREIGN PATENT DOCUMENTS

| | | | |
|---|---|---|---|
| 655,625 | 1/1963 | Canada | 72/364 |
| 2,027,240 | 8/1971 | Fed. Rep. of Germany | 72/289 |
| 22,130 | 10/1964 | Japan | 72/378 |
| 568,878 | 4/1945 | United Kingdom | 72/286 |
| 1,343,812 | 1/1974 | United Kingdom | 72/128 |

*Primary Examiner*—E. M. Combs

*Attorney, Agent, or Firm*—Sughrue, Rothwell, Mion, Zinn and Macpeak

[57] ABSTRACT

A method of hot-stretching a cable and an apparatus for practicing the same in which first, second and third capstans of different diameters, having a common rotating shaft, and having grooves on the circumferential surfaces thereof for winding the cable a plurality of turns are provided in parallel between a stranding machine and a winding machine but on the side of the stranding machine. First and second guide pulleys are provided in parallel on the side of the winding machine, and the cable is wound around said winding machine through the first capstan, the first guide pulley, the second capstan, the second guide pulley and the third capstan. A front heat treatment equipment for heating the cable is provided between the first and second capstans, and a rear heat treatment equipment for heating the cable is provided between the second and third capstans. The stranding machine is operated in such a manner that the operating speed of the stranding machine is increased to a predetermined low speed after start, and after the predetermined low speed is maintained for a predetermined period of time, the operating speed is gradually increased to the rated operating speed. The front heat treatment equipment and the rear heat treatment equipment is selectively operated as required, while a part of the cable lying between the first and second capstans and a part of the cable lying between the second and third capstans is selectively subjected to a predetermined tension, so that the whole length of the cable stranded until the operating speed of the stranding machine reaches the rated operating speed after starting is continuously and effectively subjected to a hot-stretching treatment.

7 Claims, 2 Drawing Figures

METHOD AND APPARATUS FOR CONTINUOUSLY HOT-STRETCHING A STEEL CABLE

BACKGROUND OF THE INVENTION

This invention relates to continuous hot-stretching apparatuses for giving a low relaxation characteristic to steel cables such as wire ropes and steel cables for prestressed concrete.

The hot-stretching process for steel cable, in general, involves heating a steel cable at a low temperature while applying a tension to the steel cable, which may cause a permanent elongation therein. Heretofore, such a steel cable is fabricated by a stranding machine provided separately, and then the steel cable is subjected to the hot-stretching treatment by the hot-stretching apparatus. Accordingly, the conventional method is disadvantageous in that it takes many man-hours for the conveyance of work between work stations and for work preparation, and during the period of starting the continuous hot-stretching apparatus a part of the cable lying between the heat treatment equipment and the winding machine cannot be subjected to heat treatment. Moreover, when the apparatus is stopped a part of the cable lying between the cable supplying means and the heat treatment equipment cannot be subjected to heat treatment, all of which leads to a poor yield and accordingly to an uneconomical operation.

SUMMARY OF THE INVENTION

Accordingly, it is an object of this invention to eliminate all of the above-described difficulties, and more specifically to provide a method of hot-stretching a cable and an apparatus for practicing the same in which a stranding machine and a hot-stretching apparatus specially designed are arranged in tandem, whereby the number of steps is reduced, the whole of the cable is subjected to hot-stretching treatment to increase the yield, and a low relaxation steel cable can be manufactured economically, effectively, and at a low cost.

Another object of the invention is to provide a method of hot-stretching a cable and an apparatus for practicing the same in which a steel cable having a uniform relaxation characteristic over its whole length is manufactured.

A further object of the invention is to provide an apparatus for continuously hot-stretching a cable in which a stranding machine and a hot-stretching apparatus specially designed are arranged in tandem, whereby the cost of the equipment is reduced.

According to this invention there is provided a method of hot-stretching a cable in which first, second and third capstans of different diameters, having a common rotating shaft, and having grooves on the circumferential surfaces thereof for winding the cable a plurality of turns are provided in parallel between a stranding machine and a winding machine but on the side of the stranding mechine, first and second guide pulleys are provided in parallel on the side of the winding machine, the cable is wound around the winding machine through the first capstan, the first guide pulley, the second capstan, the second guide pulley and the third capstan, a front heat treatment equipment for heating the cable is provided between the first and second capstans, and a rear heat treatment equipment for heating the cable is provided between the second and third capstans, and in which when the stranding machine is operated in such a manner that an operating speed of the stranding machine is increased to a predetermined low speed after being started, and after the predetermined low speed is maintained for a predetermined period of time, the operating speed is gradually increased to a rated operating speed thereof, the front heat treatment equipment and/or the rear heat treatment equipment is selectively operated as required, while a first part of the cable lying between the first and second capstans and/or a second part of the cable lying between the second and third capstans is selectively subjected to a predetermined tension, so that the whole length of the cable stranded until the operating speed of the stranding machine reaches the rated operating speed after starting is continuously and effectively subjected to a hot-stretching treatment.

According to the invention, for the operation of the stranding machine from its start to its rated speed operation, after starting the speeds of the stranding machine and the first capstan are gradually increased so that the cable is stranded until the operating speed of the stranding machine reaches a predetermined low speed lower than the rated speed, and when the operating speed reaches the predetermined low speed the aforementioned front heat treatment equipment and the rear heat treatment equipment are simultaneously operated, while the peripheral speed of the second capstan is made higher by as much as a predetermined value than that of the first capstan on the one hand and the peripheral speed of the third capstan is made higher by as much as a predetermined value higher than that of the second capstan on the other hand, thereby to give predetermined tensions to the parts of the cable lying between the first, second and third capstans, whereby the part of the cable stranded but not subjected to hot-stretching treatment until the operating speed of the stranding machine reaches the predetermined low speed after starting is processed by the afore-mentioned rear heat treatment equipment, and the part of the cable stranded after the operating speed of the stranding machine reaches the predetermined low speed is processed by the front heat treatment equipment. In addition, when the part processed by the front heat treatment equipment reaches the rear heat treatment equipment, the latter is stopped, and simultaneously the third capstan is allowed to rotate freely. Then the speeds of the stranding machine and the first capstan are increased from the predetermined low speeds to the rated speeds, while the heating electric power source of the front heat treatment equipment is changed so as to be suitable for the acclerating characteristic of the stranding machine, thereby gradually increasing the heating output thereof.

Provided according to this invention is an apparatus for continuously hot-stretching a cable, which comprises: first, second and third capstans of different diameters, having a common rotating shaft, and having grooves on the circumferential surfaces thereof for winding the cable a plurality of turns, the three capstans being provided in parallel between a stranding machine and a winding machine but on the side of the stranding machine; first and second guide pulleys provided in parallel on the side of the winding machine; a front heat treatment equipment provided between the first and second capstan, for heating the cable; a rear heat treatment equipment provided between the second and third capstans, for heating the cable; driving means provided for the stranding machine and first capstan, for gradually changing the operating speed thereof to a rated operating speed; means provided between said first, second and third capstans so that engagement and disengagement of the first, second and third capstans are carried out as desired; and means provided for said front and rear heat treatment equipment, so as to carry out an on-off operation, a change-over operation, and an output control operation of a heating electric power source as desired, whereby the whole length of the cable including parts thereof stranded when the stranding machine is started and stopped is subjected continuously to a uniform hot-stretching treatment.

BRIEF DESCRIPTION OF THE DRAWINGS

The foregoing objects and other objects of the invention will become more apparent from the following detailed description and the appended claims when read in conjunction with the accompanying drawings, in which like parts are designated by like reference numerals.

In the accompanying drawings.

DETAILED DESCRIPTION OF THE INVENTION

Figure 1:
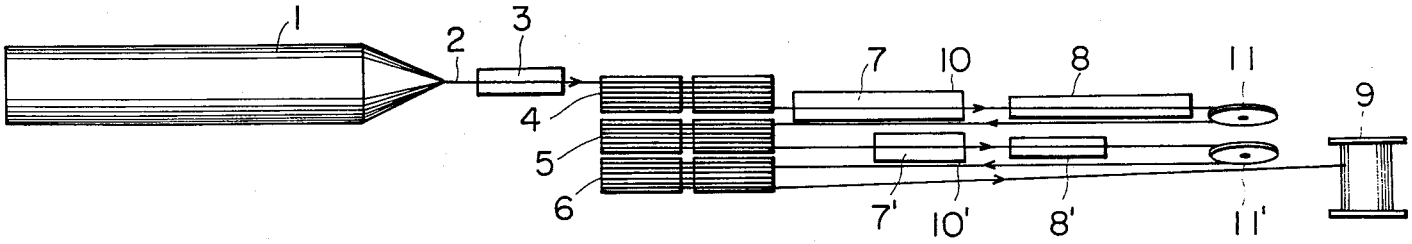
FIG. 1 is a plan view illustrating one preferred embodiment of this.

One preferred embodiment of the invention is illustrated in FIG. 1 as comprising a stranding machine 1, a steel cable 2 stranded by the stranding machine 1, a straightener 3, and double capstans 4, 5 and 6. These double capstans revolve around a common rotating shaft at peripheral velocities of predetermined ratios and are independent from one another. Each double capstan has a groove around which the cable can be wound a plurality of turns. The double capstans are gradually increased in diameter. Reference numerals 11 and 11' designate guide pulleys. After being stranded, the cable 2 is wound on a winding drum 9 through the capstan 4, the guide pulley 11, the capstan 5, a guide pulley 11', and the capstan 6. There are provided a front heating equipment 7 and a front cooling equipment 8 between the capstans 4 and 5, while there are provided a rear heating equipment 7' and a rear cooling equipment 8' between the capstans 5 and 6.

For simplification in description, the aforementioned heating equipment and cooling equipment will hereinafter be referred to as "a front heat treatment equipment" 10 and "a rear heat treatment" 10', respectively, when applicable. In the apparatus shown in FIG. 1, when the normal operation of the stranding machine 1 is carried out, the stranding machine is rotated at a rated speed while the front heating equipment 7 is operated to heat the cable at a predetermined temperature of from 250° C to 400° C. In this operation, a tension is applied to the cable by the difference in velocity between the capstans 4 and 5, and the cable is subjected to a hot stretching treatment. In this case, the capstan 6 is rotated at the same peripheral velocity as the capstan 5, and after being wound on the capstan 5 several turns the cable thus subjected to the hot-stretching treatment is released from the tension, and is then wound on the take-up drum 9 through the rear heat treatment equipment 10'.

In case it is necessary to temporarily stop the stranding machine 1 which is carrying out its normal operation, because of connection of strands of the cable or other reasons, a stop button (not shown) of the heating equipment is depressed to disconnect the front heating equipment 7 from an electric power supply (not shown) and simultaneously to synchronize the peripheral velocity of the capstan 5 to that of the capstan 4. Thereafter, by depressing a stop button (not shown) of the stranding machine 1, the latter is stopped. However, generally the cable is stranded three to five meters by the inertia of the stranding machine 1 before it is completely stopped. A part of the cable which is allowed to come out of the stranding machine by this inertia is not subjected to the hot stretching treatment; that is, it is wound, as an incomplete part of the cable, around the capstan 5. In this case, when the stranding machine 1 is started again, the stranding machine 1 is started at a low speed approximately one half of the rated speed of its normal operation by means of a D.C. motor or a pole change motor, and the cable is stranded 5 to 6 meters until the speed of the stranding machine 1 is gradually increased to a predetermined low speed. When the stranding machine 1 reaches the aforementioned predetermined low speed, the front and rear heating equipments 7 and 7' are operated at the same time so as to heat the cable to a temperature of 250°–400° C, while velocity differences are established between the capstans 4 and 5 and between the capstans 5 and 6, respectively, thereby to give a predetermined tension to the cable.

In this connection, it goes without saying that the heating equipments 7 and 7' are so designed as to heat the cable to the predetermined temperature at the predetermined low speed and that the velocity differences between the capstans 4, 5 and 6 are so designed as to provide the predetermined tensions.

By means of the front continuous tensioning and heating equipment and the rear continous tensioning and heating equipment, the part of the cable stranded after the predetermined operation of the stranding machine is subjected to the hot-stretching treatment. Also, both the part of the cable stranded due to the inertia of the stranding machine which is at rest on the capstan 5 and the part of the cable stranded before the stranding machine is operated at the predetermined low speed when started is subjected to the hot stretching treatment by the rear continous tensioning and heating equipment. Then, when the stranded part which is stranded when the stranding machine is started again and is further subjected to the hot stretching treatment by the front continuous tensioning and heating equipment, reaches the rear heating equipment 7', the heating operation of the rear heating equipment 7' is suspended and simultaneously the peripheral velocity of the capstan 6 is synchronized with that of the capstan 5, thereby removing the tension applied to the cable. Thereafter, while the power supply of the aforementioned rear heating equipment 7' is being added to the power supply of the front heating equipment 7, the output is increased on the one hand, and while the velocity difference between the capstans 4 and 5 is maintained unchanged, the speed is increased to the rated speed for normal operation. Thus, the strand parts which have not been subjected to the hot-stretching treatment during the stop and start of the stranding machine are continuously treated.

Figure 2:
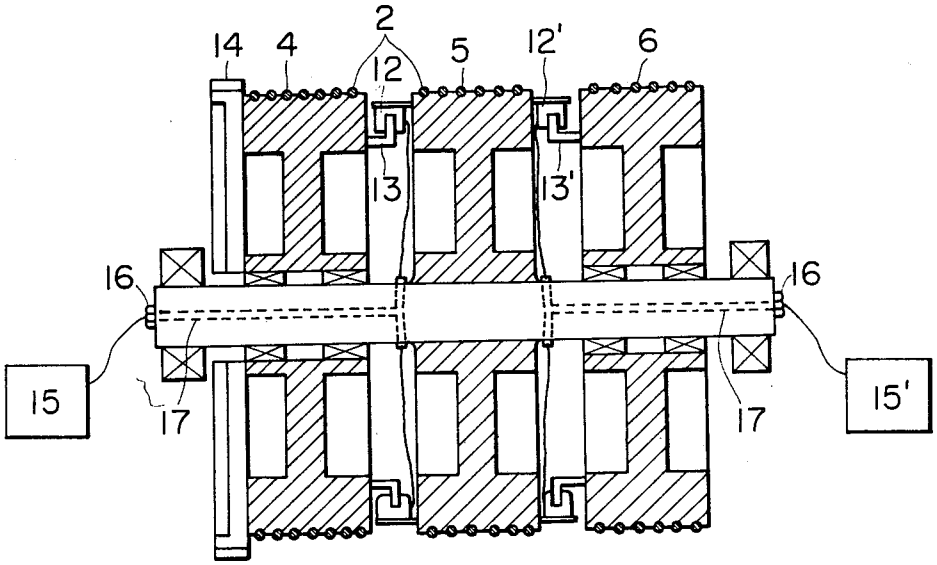
FIG. 2 is a sectional view showing a velocity difference giving machanism in the tensioning devide comprising the capstans shown in FIG. 1.

FIG. 2 is a sectional view illustrating a tensioning device comprising the capstans 4, 5 and 6. More specifically, FIG. 2 shows a velocity difference giving mechanism for three independent capstans whose diameters are different from one another in predetermined ratios.

In FIG. 2, reference numerals 12 and 13 designate a front disk brake caliper and a front disk plate, respectively. The disk brake caliper 12 is secured to the capstan 5, while the disk plate 13 is secured to the capstan 4. Reference numerals 12' and 13' designate a rear disk brake caliper and a rear disk plate, respectively. The disk brake caliper 12' is secured to a surface of the capstan 5 which is opposite to the surface thereof where the front disk brake caliper 12 is provided. The disk plate 13' is secured to the capstan 6. A gear 14 is fixedly secured to the capstan 4. The gear is coupled to the rotating shaft of the stranding machine 1 through a gear, and a reduction gear (not shown). In this device thus organized, when the stranding machine 1 is in a normal operation state, a hydraulic pump 15 is operated so that hydraulic oil in conduit 17, which is supplied through a rotary seal 16, is supplied to the disk brake caliper 12 under a constant pressure. By the operation of the disk brake, the capstans 4 and 5 are rotated as one unit; however, as the diameter of the capstan 5 is larger by as much as the predetermined ratio than that of the capstan 4, the peripheral velocity of the capstan 5 is higher by as much as the diameter ratio than that of the capstan 4. Accordingly, a velocity difference is established between the capstans 4 and 5, and therefore a tension is applied to the cable laid between the capstans 4 and 5. It goes without saying that in this case the cable is wound around the capstans a sufficient number of turns so that the cable does not slip on the surfaces of the capstans.

In the case when the stranding machine carrying out its normal operation is temporarily stopped because of the connection of the strands or other reasons, the hydraulic pump 15 is stopped, as a result of which the disk brake oil pressure is decreased, the capstans 4 and 5 rotating as one unit are disconnected from each other, thereby removing the tension applied to the cable.

Next, when the stranding machine is started again, hydraulic pumps 15 and 15' are operated to apply oil pressure to the front and rear disk brake calipers so that the capstans 4, 5 and 6 are rotated as one unit. Since the diameter of the capstan 6 is larger by as much as the predetermined ratio than that of the capstan 5, the peripheral velocity of the former is higher by as much as the diameter ratio ratio than that of the latter, as a result of which a tension is applied to the cable laid between the capstans 5 and 6. Accordingly, the parts of the cable which have not been subjected to the tension treatment when the stranding mechine 1 is stopped and started again are subjected to the tension treatment while passing through the capstans 5 and 6.

When the part subjected to the tensioning and heating treatment between the capstans 4 and 5 reaches the rear heating equipment, the hydraulic pump 15' is stopped so that the oil pressure applied to the rear disk brake is decreased and the capstan 5 is disengaged from the capstan 6 to release the tension. Thereafter, keeping the capstans 4 and 5 as one unit, the speed of the stranding machine is increased to the rated speed for normal operation.

In addition, in the case where this apparatus is used merely for heat treatment or bluing treatment (annealing at low temperature) without giving a tension to the cable, the disk brake oil pressure is set to such a low pressure that no tension is applied to the steel cable, and the capstans 4, 5 and 6 are independent of one another.

In the above description, the disk brakes are employed for engaging or disengaging the capstans 4, 5 and 6; however, it should be noted that the invention is not limited thereto. That is, other switching devices such as clutches can be employed for this purpose.

As is apparent from the above description, in this invention, the hot-stretching device and the stranding machine are provided in tandem. Therefore, the number of steps required for conveyance of work and preoperational work can be reduced, which leads to labor saving.

In the conventional hot stretching treatment which is carried out as a separate process, if heating is carried out for a steel cable after it has been tensioned, the steel cable may be broken. Therefore, in the conventional hot-stretching treatment, the tension treatment is carried out after the heating treatment has been done. Accordingly, a part of the cable is not subjected to the hot-stretching treatment whenever the apparatus is stopped and started again. On the other hand, in this invention, such part is also subjected to the hot stretching treatment. Accordingly, the hot-stretching treatment is applied uniformly to the entire length of the cable. In addition, in this invention, as no tension is applied to the cable in a cold state, the strength of the equipment concerned can be a half of the strength of the conventional equipment.

In addition, in this invention, in tensioning the cable, slipping of the cable on the capstans can be prevented by utilizing the back tension due to the stranding machine. Therefore, the number of turns of the cable wound on each capstan can be less, which leads to compactness of the apparatus.

Furthermore, in this invention, as the diameter differences between two adjacent capstans are predetermined and the peripheral velocity difference therebetween is constant, the tension applied to the cable is maintained unchanged.

In addition, according to the invention, as the cable is wound on the capstans a sufficient number of turns to prevent slipping between the cable and the capstans, and unlike the conventional caterpillar capstans, the apparatus of this invention will never suffer from the great wearing out of the clamp member thereof. Therefore, the invention is advantageous in that the service life of the capstan is lengthened and maintenance thereby reduced.

In the invention, as the capstans with different diameters are coupled to one another through the disk brakes, engagement and disengagement of the capstans can be readily carried out. Therefore, the apparatus according to the invention has merits that it is simple in operation, compact in size, and simple in maintenance.

While only one embodiment of the method and apparatus according to this invention have been illustrated and described in detail, it is to be understood that the invention is not limited thereto, and it will be obvious to those skilled in the art that various changes and modifications may be made therein without departing from the invention.

What is claimed is:

1. A method of hot-stretching a cable in which first, second and third capstans of different diameters, having a common rotating shaft, and having grooves on the circumferential surfaces thereof for winding said cable a plurality of turns are provided in parallel between a stranding machine and a winding machine and positioned adjacent to the stranding machine, first and second guide pulleys are provided in parallel and positioned adjacent to the winding machine, a front heat treatment equipment for heating said cable is provided between said first capstan and said second capstan, and a rear heat treatment equipment for heating said cable is provided between said second capstan and said third capstan, said method comprising the steps of winding said cable around said winding machine through said first capstan, said first guide pulley, said second capstan, said second guide pulley and said third capstan, increasing the operating speed of said stranding machine to a predetermined low speed after starting, and after the predetermined low speed is maintained for a predetermined period of time, gradually increasing the operating speed to a rated operating speed of said stranding machine, and selectively operating said front heat treatment equipment and said rear heat treatment equipment, while at the same time selectively subjecting a first part of said cable lying between said first capstan and said second capstan and a second part of said cable lying between said second capstan and said third capstan to a predetermined tension, until the operating speed of said stranding machine reaches said rated operating speed after starting so that the entire length of said stranded cable is continuously and effectively subjected to a hot-stretching treatment.

2. A method as claimed in claim 1, in which the step of subjecting said first part of said cable lying between said first capstan and said second capstan and said second part of said cable lying between said second capstan and said third capstan to predetermined tensions is performed respectively by making the peripheral velocity of said second capstan higher by as much as a predetermined value than that of said first capstan and by making the peripheral velocity of said third capstan higher by as much as a predetermined value than that of said second capstan.

3. A method as claimed in claim 1, in which for a period of time during which said predetermined low speed is maintained after said operating speed of said stranding machine has reached said predetermined low speed, both of said front and rear heat treatment equipment are operated, and said first part of said cable lying between said first capstan and said second capstan and said second part of said cable lying between said second capstan and said third capstan are subjected to said predetermined tensions, respectively, so that a part of said cable stranded for a period of time from the instant when said stranding machine is started to the time when said operating speed of said stranding machine reaches said predetermined low speed is subjected to a hot-stretching treatment by said rear heat treatment equipment, while a part of said cable stranded for a period of time during which said operating speed of said stranding machine is maintained at said predetermined low speed is subjected to a hot-stretching treatment by said front heat treatment equipment.

4. A method as claimed in claim 1, in which for a period of time during which said operating speed of said stranding machine is gradually increased from said predetermined low speed to said rated speed, a predetermined tension is applied to only a part of said cable lying between said first capstan and said second capstan, and only said front heat treatment equipment is operated in such a manner that a heating output of said front heat treatment equipment is gradually increased so that said heating output is compatible with an accelerating characteristic of said stranding machine.

5. An apparatus for hot-stretching a cable, which comprises:

first, second and third capstans of different diameters, having a common rotating shaft, and having grooves on the circumferential surfaces thereof for winding said cable a plurality of turns, said three capstans being provided in parallel between a stranding machine, and a winding machine and positioned adjacent to the stranding machine;

first and second guide pulleys provided in parallel and positioned adjacent to said winding machine;

a front heat treatment equipment provided between said first capstan and said second capstan, for heating said cable;

a rear heat treatment equipment provided between said second capstan and said third capstan, for heating said cable;

driving means provided for said stranding machine and said first capstan for gradually changing an operating speed thereof to a rated operating speed from starting;

means provided between said first, second and third capstans for providing selective engagement and disengagement of said first, second and third capstans as desired; and an electric power source for selectively operating said front and rear heat treatment equipment, so as to effect an on-off operation, a changeover operation, and an output control operation as desired, whereby the whole length of said cable including parts thereof stranded when said stranding machine is started and stopped is subjected continuously to a uniform hot-stretching treatment.

6. An apparatus as claimed in claim 5, in which each of said front heat treatment equipment and said rear heat treatment comprises a heating equipment and a cooling equipment.

7. An apparatus as claimed in claim 5, in which said means for providing selective engagement and disengagement of said capstans as desired is a hydraulic disk brake.

* * * * *